US012503287B2

(12) United States Patent
Smalley

(10) Patent No.: US 12,503,287 B2
(45) **Date of Patent: *Dec. 23, 2025**

(54) CARRIER FOR CONTAINERS

(71) Applicant: Graphic Packaging International, LLC, Atlanta, GA (US)

(72) Inventor: Brian Smalley, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/413,205

(22) Filed: Jan. 16, 2024

(65) Prior Publication Data

US 2024/0150102 A1 May 9, 2024

Related U.S. Application Data

(63) Continuation of application No. 17/478,025, filed on Sep. 17, 2021, now Pat. No. 11,919,692, which is a (Continued)

(51) Int. Cl.
*B65D 71/48* (2006.01)
*B65D 71/52* (2006.01)

(52) U.S. Cl.
CPC ..... *B65D 71/48* (2013.01); *B65D 71/0003* (2013.01); *B65D 2571/0066* (2013.01); (Continued)

(58) Field of Classification Search
CPC ..... B65D 2571/00932; B65D 2571/00925; B65D 2571/00716; B65D 2571/0066; (Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
CA 2133827 10/1993
(Continued)

OTHER PUBLICATIONS

International Search Report and Written Opinion for PCT/US2019/034491 dated Sep. 19, 2019.
(Continued)

*Primary Examiner* — Chun Hoi Cheung

(74) *Attorney, Agent, or Firm* — Andrew N. Claerbout; FisherBroyles, LLC

(57) ABSTRACT

A carrier for holding a plurality of containers includes a plurality of panels that includes a at least two central panels and at least one attachment panel configured to receive a portion of one or more containers of the plurality of containers. The at least two central panels include a first central panel foldably connected to a second central panel. The first central panel has at least one opening and a portion of the second central panel is exposed through the at least one opening when the first central panel and the second central panel are in at least partial face-to-face contact.

38 Claims, 9 Drawing Sheets

Related U.S. Application Data continuation of application No. 16/426,066, filed on May 30, 2019, now Pat. No. 11,180,301.

(60) Provisional application No. 62/841,449, filed on May 1, 2019, provisional application No. 62/817,120, filed on Mar. 12, 2019, provisional application No. 62/814,412, filed on Mar. 6, 2019, provisional application No. 62/810,015, filed on Feb. 25, 2019, provisional application No. 62/797,585, filed on Jan. 28, 2019, provisional application No. 62/796,830, filed on Jan. 25, 2019, provisional application No. 62/783,752, filed on Dec. 21, 2018, provisional application No. 62/779,689, filed on Dec. 14, 2018.

(52) U.S. Cl.
CPC ..... *B65D 2571/00716* (2013.01); *B65D 2571/00925* (2013.01); *B65D 2571/00932* (2013.01)

(58) Field of Classification Search
CPC .... B65D 71/0003; B65D 71/48; B65D 71/71; B65D 75/04; B65D 75/00; B65D 71/44; B65D 71/42; B65D 71/12
USPC ..... 206/151–155, 139–203
See application file for complete search history.

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,950,041 A 8/1960 Stone
2,965,410 A 12/1960 Hughes
3,001,647 A 9/1961 Liss
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
3,200,944 A 8/1965 Rapata
3,204,814 A * 9/1965 Mahon ..... B65D 71/246 206/162
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,528,697 A 9/1970 Wood
3,587,847 A 6/1971 Graser
3,601,439 A 8/1971 Poupitch
3,612,266 A 10/1971 Graser
D222,579 S 11/1971 Oglesbee
3,622,266 A 11/1971 Laukel
3,627,121 A 12/1971 Deasy
3,653,503 A 4/1972 Arneson
3,693,787 A 9/1972 Duerr
3,698,550 A 10/1972 Graser
3,701,416 A 10/1972 Lawrence
3,722,945 A 3/1973 Wood
3,726,558 A 4/1973 Klygis
3,734,278 A 5/1973 Kerrigan
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,078,357 A 3/1978 Ida
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
D257,001 S 9/1980 Oliff
4,244,617 A 1/1981 Manizza
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,523,676 A 6/1985 Barrash
D294,331 S 2/1988 Panazzolo
4,784,266 A 11/1988 Chaussadas
D304,017 S 10/1989 Oliff
4,911,288 A 3/1990 Dantoin, Jr.
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
D329,807 S 9/1992 Heider
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,446 A 6/1995 Weaver
5,443,153 A 8/1995 Sutherland
5,445,262 A 8/1995 Sutherland
5,452,799 A 9/1995 Sutherland
5,469,687 A 11/1995 Olson
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,551,566 A 9/1996 Sutherland
5,553,704 A 9/1996 Gordon et al.

(56) References Cited

U.S. PATENT DOCUMENTS

| | | | | |
|---|---|---|---|---|
| 5,553,705 | A | 9/1996 | Bakx | |
| 5,573,111 | A | 11/1996 | Gordon | |
| 5,590,776 | A | 1/1997 | Galbierz | |
| 5,593,027 | A | 1/1997 | Sutherland | |
| 5,609,247 | A | 3/1997 | Appleton | |
| 5,609,251 | A | 3/1997 | Harris | |
| 5,609,379 | A | 3/1997 | Harrelson | |
| 5,639,137 | A | 6/1997 | Bakx | |
| 5,682,982 | A | 11/1997 | Stonehouse | |
| 5,706,936 | A | 1/1998 | Bernstein | |
| 5,711,419 | A | 1/1998 | Beales et al. | |
| 5,735,394 | A | 4/1998 | Harrelson | |
| 5,746,310 | A | 5/1998 | Slomski | |
| 5,762,193 | A | 6/1998 | Marco | |
| 5,791,463 | A | 8/1998 | Negelen | |
| 5,816,391 | A | 10/1998 | Harris | |
| 5,845,776 | A | 12/1998 | Galbierz et al. | |
| 5,878,876 | A | 3/1999 | Galbierz et al. | |
| 5,960,945 | A | 10/1999 | Sutherland | |
| 6,039,181 | A | 3/2000 | Whiteside | |
| 6,059,099 | A | 5/2000 | Galbierz | |
| 6,082,532 | A | 7/2000 | Miess | |
| 6,145,656 | A | 11/2000 | Marco | |
| 6,168,012 | B1 | 1/2001 | Galbierz | |
| 6,213,293 | B1 | 4/2001 | Marco | |
| 6,293,392 | B1 | 9/2001 | Galbierz | |
| 6,315,111 | B1 | 11/2001 | Sutherland | |
| 6,341,689 | B1 * | 1/2002 | Jones | B65D 71/0022 206/427 |
| 6,394,272 | B1 | 5/2002 | Domansky | |
| 6,896,130 | B2 | 5/2005 | Theelen | |
| D506,925 | S | 7/2005 | Plumer | |
| 7,011,209 | B2 | 3/2006 | Sutherland et al. | |
| 7,604,115 | B2 * | 10/2009 | Cuomo | B65D 71/0077 206/170 |
| 7,690,507 | B2 | 4/2010 | Sutherland | |
| 7,721,878 | B2 | 5/2010 | Requena | |
| 7,762,397 | B2 | 7/2010 | Coltri-Johnson et al. | |
| 7,789,231 | B2 | 9/2010 | Requena | |
| 7,823,721 | B2 | 11/2010 | Sutherland et al. | |
| 8,056,709 | B2 | 11/2011 | Sutherland | |
| 8,096,413 | B2 | 1/2012 | DePaula | |
| 8,162,135 | B2 | 4/2012 | Oliveira | |
| 8,353,398 | B2 | 1/2013 | DePaula et al. | |
| 8,387,784 | B2 | 3/2013 | Gonzalez et al. | |
| 8,443,968 | B2 | 5/2013 | DePaula | |
| 8,464,866 | B2 | 6/2013 | Sutherland et al. | |
| 8,469,184 | B2 | 6/2013 | Spivey, Sr. | |
| 8,602,209 | B2 | 12/2013 | Jones et al. | |
| 8,631,932 | B2 | 1/2014 | Holley, Jr. | |
| 8,701,878 | B2 | 4/2014 | Spivey, Sr. | |
| 8,925,720 | B2 | 1/2015 | Sutherland et al. | |
| 8,936,149 | B2 | 1/2015 | Smalley | |
| 8,955,674 | B2 | 2/2015 | Spivey, Sr. et al. | |
| 9,079,699 | B2 | 7/2015 | Holley, Jr. | |
| 9,169,050 | B2 | 10/2015 | Spivey, Sr. | |
| 9,284,090 | B2 | 3/2016 | Lettre | |
| 9,359,093 | B2 | 6/2016 | DePaula et al. | |
| 9,376,250 | B2 | 6/2016 | Spivey, Sr. | |
| D767,408 | S | 9/2016 | Shuster | |
| 9,446,891 | B2 | 9/2016 | Jones et al. | |
| 9,511,916 | B2 | 12/2016 | Holley, Jr. | |
| 9,669,976 | B2 | 6/2017 | Kastanek et al. | |
| 9,676,535 | B2 | 6/2017 | Spivey, Sr. | |
| 10,077,131 | B2 | 9/2018 | Lettre | |
| D881,021 | S | 4/2020 | Bandinu | |
| D881,718 | S | 4/2020 | Bandinu | |
| 10,836,550 | B2 | 11/2020 | Zacherle | |
| D918,057 | S | 5/2021 | L'Heureux | |
| D918,058 | S | 5/2021 | L'Heureux | |
| 11,014,727 | B2 | 5/2021 | McCree | |
| D920,809 | S | 6/2021 | Chesnet et al. | |
| D921,493 | S | 6/2021 | Chesnet | |
| D923,416 | S | 6/2021 | Luciano | |
| 11,027,904 | B2 | 6/2021 | McCree | |
| 11,027,905 | B2 | 6/2021 | Ford | |
| 11,180,301 | B2 | 11/2021 | Smalley | |
| D944,656 | S | 3/2022 | Spivey, Sr. | |
| D946,416 | S | 3/2022 | Smalley | |
| D946,417 | S | 3/2022 | Gonzalez Manzano | |
| D946,418 | S | 3/2022 | Gonzalez Manzano | |
| D946,419 | S | 3/2022 | Gonzalez Manzano | |
| D946,420 | S | 3/2022 | Gonzalez Manzano | |
| D946,421 | S | 3/2022 | Gonzalez Manzano | |
| 11,261,013 | B2 | 3/2022 | Smalley | |
| 11,286,094 | B2 | 3/2022 | Gonzalez Manzano | |
| D955,889 | S | 6/2022 | Gonzalez Manzano | |
| D955,890 | S | 6/2022 | Gonzalez Manzano | |
| D956,574 | S | 7/2022 | Gonzalez Manzano | |
| 11,401,095 | B2 | 8/2022 | Rosenbrien | |
| 11,420,802 | B2 | 8/2022 | Kooc | |
| D962,789 | S | 9/2022 | Noel | |
| 2002/0195371 | A1 | 12/2002 | Brown | |
| 2003/0080004 | A1 | 5/2003 | Olsen et al. | |
| 2003/0213705 | A1 | 11/2003 | Woog | |
| 2004/0206639 | A1 | 10/2004 | Karlsson | |
| 2004/0211695 | A1 | 10/2004 | Karlsson | |
| 2004/0226833 | A1 | 11/2004 | Daniel | |
| 2005/0127151 | A1 | 6/2005 | Johnson | |
| 2005/0199513 | A1 | 9/2005 | Bakx et al. | |
| 2006/0255114 | A1 | 11/2006 | Hand et al. | |
| 2007/0080084 | A1 | 4/2007 | Sutherland | |
| 2007/0163908 | A1 | 7/2007 | Sutherland | |
| 2009/0101526 | A1 | 4/2009 | Sutherland et al. | |
| 2009/0127147 | A1 | 5/2009 | Sutherland | |
| 2010/0078337 | A1 | 4/2010 | Sutherland et al. | |
| 2010/0264043 | A1 | 10/2010 | DePaula | |
| 2011/0000799 | A1 | 1/2011 | Gonzalez | |
| 2012/0138489 | A1 | 6/2012 | Holley, Jr. | |
| 2015/0191287 | A1 | 7/2015 | L'Heureux et al. | |
| 2016/0325899 | A1 | 11/2016 | L'Heureux et al. | |
| 2018/0111734 | A1 | 4/2018 | Jego | |
| 2018/0222650 | A1 | 8/2018 | Zacherle | |
| 2018/0362234 | A1 | 12/2018 | L'Heureux et al. | |
| 2019/0119019 | A1 | 4/2019 | Patton | |
| 2020/0010255 | A1 | 1/2020 | Zacherle et al. | |
| 2020/0079564 | A1 | 3/2020 | Ford | |
| 2020/0189817 | A1 | 6/2020 | Smalley | |
| 2020/0189818 | A1 | 6/2020 | McCree | |
| 2020/0189819 | A1 | 6/2020 | McCree | |
| 2020/0189821 | A1 | 6/2020 | Smalley | |
| 2020/0189822 | A1 | 6/2020 | Smalley | |
| 2020/0223612 | A1 | 7/2020 | Swenson | |
| 2021/0061502 | A1 | 3/2021 | Johnston | |
| 2021/0094742 | A1 | 4/2021 | Gonzalez Manzano | |
| 2021/0276776 | A1 | 9/2021 | Zammit | |
| 2021/0316921 | A1 | 10/2021 | Holtz | |
| 2021/0331847 | A1 | 10/2021 | Gonzalez Manzano | |
| 2021/0331848 | A1 | 10/2021 | Gonzalez Manzano | |
| 2021/0339928 | A1 | 11/2021 | Blin | |
| 2022/0009685 | A1 | 1/2022 | Thompson | |
| 2022/0097941 | A1 | 3/2022 | McCree | |
| 2022/0340343 | A1 | 10/2022 | Van De Vegte | |

FOREIGN PATENT DOCUMENTS

| | | |
|---|---|---|
| CN | 1863708 | 11/2006 |
| CN | 101124124 | 2/2008 |
| CN | 101549771 | 10/2009 |
| CN | 102333706 | 1/2012 |
| DE | 298 13 672 U1 | 11/1998 |
| DE | 203 19 247 U1 | 5/2004 |
| DE | 10 2009 059 047 A1 | 6/2011 |
| EP | 0 051 413 A1 | 5/1982 |
| EP | 0 060 504 A2 | 9/1982 |
| EP | 0 057 437 B1 | 5/1985 |
| EP | 0 496 807 | 6/1993 |
| EP | 0 636 096 | 2/1995 |
| EP | 0 715 593 A1 | 6/1996 |
| EP | 0 398 835 B1 | 10/1996 |
| EP | 2 067 713 A1 | 6/2009 |
| EP | 1 528 007 B1 | 10/2010 |
| EP | 2739547 B1 | 7/2017 |
| EP | 3 666 684 A1 | 6/2020 |

(56) References Cited

FOREIGN PATENT DOCUMENTS

| | | | |
|---|---|---|---|
| EP | 3 666 685 | A1 | 6/2020 |
| EP | 3842360 | | 6/2021 |
| FR | 2 737 196 | A1 | 1/1997 |
| GB | 1 256 684 | | 12/1971 |
| GB | 1266740 | | 3/1972 |
| GB | 2 321 229 | A | 7/1998 |
| GB | 9006736716 | | 8/2019 |
| GB | 2591535 | A | 8/2021 |
| GB | 6161591 | | 9/2021 |
| IT | 202000015709 | | 12/2021 |
| JP | 37-15730 | | 9/1960 |
| JP | 10-297668 | A | 11/1998 |
| JP | H11193059 | | 7/1999 |
| JP | 2001-519300 | A | 10/2001 |
| JP | 2003-146359 | | 5/2003 |
| JP | 2004-189243 | A | 7/2004 |
| JP | 2006151468 | | 6/2006 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 96/26128 | A1 | 8/1996 |
| WO | WO 96/32340 | A1 | 10/1996 |
| WO | WO 2006/044583 | A2 | 4/2006 |
| WO | WO 2008/058294 | A1 | 5/2008 |
| WO | WO 2010/006629 | A1 | 1/2010 |
| WO | WO 2010/101852 | A1 | 9/2010 |
| WO | 2013106800 | | 7/2013 |
| WO | WO 2016/100010 | A1 | 6/2016 |
| WO | WO 2016/112145 | A1 | 7/2016 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

International Search Report and Written Opinion for PCT/US2019/034490 dated Sep. 19, 2019.
International Search Report and Written Opinion for PCT/US2019/034494 dated Sep. 19, 2019.
International Search Report and Written Opinion for PCT/US2019/034489 dated Sep. 19, 2019.
International Search Report and Written Opinion for PCT/US2019/034493 dated Sep. 20, 2019.
International Search Report and Written Opinion for PCT/US2020/024614 dated Sep. 15, 2020.
European Search Report for EP 19 18 0439 dated Jan. 10, 2020.
European Search Report for EP 19 18 0460 dated Jan. 13, 2020.
European Search Report for EP 19 18 0436 dated Jan. 22, 2020.
European Search Report for EP 19 18 0446 dated Feb. 3, 2020.
European Search Report for EP 19 18 0453 dated Feb. 10, 2020.
European Search Report for EP 20 16 8268 dated Oct. 2, 2020.
International Search Report and Written Opinion for PCT/US2020/054205 dated Jan. 20, 2021.
International Search Report and Written Opinion for PCT/US2020/064472 dated Mar. 15, 2021.
International Search Report and Written Opinion for PCT/US2020/064471 dated Mar. 29, 2021.
International Search Report and Written Opinion for PCT/US2020/064473 dated Apr. 1, 2021.
European Search Report for EP 20 20 533 dated Mar. 23, 2021.
European Search Report for EP 20 21 5364 dated Jul. 1, 2021.
European Search Report for EP 20 21 5371 dated Jul. 1, 2021.
European Search Report for EP 20 21 5399 dated Jul. 1, 2021.
Amendment Under 37 C.F.R. § 1.312 for U.S. Appl. No. 16/426,066 dated Oct. 11, 2021.
Issue Fee Transmittal for U.S. Appl. No. 16/426,066 dated Oct. 11, 2021.
Notice of Allowance and Fee(s) Due for U.S. Appl. No. 16/426,066 dated Sep. 13, 2021.
Amendment A and Response to Office Action for U.S. Appl. No. 16/426,066 dated Jul. 1, 2021.
Office Action for U.S. Appl. No. 16/426,066 dated May 26, 2021.
Response to Restriction Requirement for U.S. Appl. No. 16/426,066 dated Apr. 28, 2021.
Office Action for U.S. Appl. No. 16/426,066 dated Mar. 23, 2021.
Notice of Reasons for Refusal for Japanese Patent Application No. 2021-533738 dated Mar. 7, 2023 with translation.
"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/ florida-saltwater-brewery-non-plastic-six-pack-rings-spare-sea-turtles/ (Year: 2018).
"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).
Enviroclip. Date posted: 2022. Site visited: Sep. 12, 2022. Available online: https://www.graphicpkg.com/products/enviroclip/ (Year: 2022).
"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).
"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).
Cap-it packaging video on Vimeo. Date posted: 2021. Site visited: Sep. 19, 2022. Available online: https://vimeo.com/610619455?embedded=true&source=vimeo_logo&owner=24551687 (Year: 2021).
2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).
International Search Report and Written Opinion for PCT/US2021/052279 dated Jan. 5, 2022.
International Search Report and Written Opinion for PCT/US2021/052278 dated Jan. 5, 2022.
International Search Report and Written Opinion for PCT/US2021/052272 dated Jan. 7, 2022.
International Search Report and Written Opinion for PCT/US2021/052290 dated Jan. 21, 2022.
Issue Fee Transmittal Form for U.S. Appl. No. 17/478,025 dated Jan. 16, 2024.
Response to Rule 312 Communication for U.S. Appl. No. 17/478,025 dated Jan. 11, 2024.
Amendment Under 37 C.F.R. § 1.312 for U.S. Appl. No. 17/478,025 dated Dec. 19, 2023.
Notice of Allowance and Fee(s) Due for U.S. Appl. No. 17/478,025 dated Oct. 18, 2023.
Amendment C and Response to Office Action for U.S. Appl. No. 17/478,025 dated Aug. 23, 2023.
Office Action for U.S. Appl. No. 17/478,025 dated Apr. 24, 2023.
Request for Continued Examination (RCE) Transmittal for U.S. Appl. No. 17/478,025 dated Apr. 11, 2023.
Amendment B and Response to Final Office Action for U.S. Appl. No. 17/478,025 dated Apr. 11, 2023.
Office Action for U.S. Appl. No. 17/478,025 dated Jan. 12, 2023.
Amendment A and Response to Office Action for U.S. Appl. No. 17/478,025 dated Oct. 27, 2022.
Office Action for U.S. Appl. No. 17/478,025 dated Jul. 29, 2022.
Notice of Reasons for Refusal for Japanese Patent Application No. 2022-521248 dated Jan. 15, 2024, with English translation.
Request for the Submission of an Opinion for Korean Patent Application No. 10-2021-7021580 dated Dec. 26, 2023, with English translation.
U.S. Appl. No. 29/709,918, filed Oct. 18, 2019.

(56) References Cited

OTHER PUBLICATIONS

U.S. Appl. No. 29/735,178, filed May 19, 2020.
U.S. Appl. No. 29/739,927, filed Jun. 30, 2020.
U.S. Appl. No. 29/739,929, filed Jun. 30, 2020.
U.S. Appl. No. 29/739,931, filed Jun. 30, 2020.
U.S. Appl. No. 29/739,933, filed Jun. 30, 2020.
U.S. Appl. No. 29/739,934, filed Jun. 30, 2020.
U.S. Appl. No. 29/775,557, filed Mar. 24, 2021.
U.S. Appl. No. 29/775,558, filed Mar. 24, 2021.
U.S. Appl. No. 29/775,559, filed Mar. 24, 2021.
U.S. Appl. No. 29/775,560, filed Mar. 24, 2021.
U.S. Appl. No. 29/818,355, filed Dec. 8, 2021.
U.S. Appl. No. 29/819,435, filed Dec. 15, 2021.
U.S. Appl. No. 29/819,437, filed Dec. 15, 2021.
U.S. Appl. No. 29/819,438, filed Dec. 15, 2021.
U.S. Appl. No. 29/819,440, filed Dec. 15, 2021.
Amendment A and Response to Office Action for U.S. Appl. No. 16/426,057 dated Oct. 8, 2020 (pp. 1-1).
Amendment A and Response to Office Action for U.S. Appl. No. 16/937,043 dated Jan. 19, 2022 (pp. 1-1).
Amendment A and Response to Restriction Requirement for U.S. Appl. No. 29/739,927 dated Dec. 1, 2021 (pp. 1-1).
Amendment A and Response to Restriction Requirement for U.S. Appl. No. 29/739,931 dated Decemeber 1, 2021 (pp. 1-1).
Amendment B and Response to Office Action for U.S. Appl. No. 16/426,057 dated Feb. 3, 2021 (pp. 1-1).
Corrected Notice of Allowability for U.S. Appl. No. 16/426,057 dated May 12, 2021 (pp. 1-3).
Issue Fee Transmittal for U.S. Appl. No. 16/426,057 dated May 5, 2021 (pp. 1-2).
Issue Fee Transmittal Form for U.S. Appl. No. 29/739,927 dated Jan. 26, 2022 (pp. 1-2).
Issue Fee Transmittal Form for U.S. Appl. No. 29/739,931 dated Jan. 26, 2022 (pp. 1-2).
Issue Notification for U.S. Appl. No. 16/426,057 dated May 19, 2021 (pp. 1-1).
Notice of Allowance and Fee(s) Due for U.S. Appl. No. 16/426,057 dated Feb. 22, 2021 (pp. 1-5).
Notice of Allowance and Fee(s) Due for U.S. Appl. No. 29/739,927 dated Jan. 6, 2022 (pp. 1-5).
Notice of Allowance and Fee(s) Due for U.S. Appl. No. 29/739,931 dated Jan. 12, 2022 (pp. 1-5).
Office Action for U.S. Appl. No. 16/426,057 dated Apr. 22, 2020 (pp. 1-6).
Office Action for U.S. Appl. No. 16/426,057 dated Jul. 17, 2020 (pp. 1-9).
Office Action for U.S. Appl. No. 16/426,057 dated Nov. 6, 2020 (pp. 1-6).
Office Action for U.S. Appl. No. 16/937,043 dated Jul. 1, 2021 (pp. 1-6).
Office Action for U.S. Appl. No. 16/937,043 dated May 21, 2021 (pp. 1-6).
Office Action for U.S. Appl. No. 16/937,043 dated Oct. 21, 2021 (pp. 1-8).
Office Action for U.S. Appl. No. 29/739,927 dated Oct. 28, 2021 (pp. 1-6).
Office action for U.S. Appl. No. 29/739,931 dated Oct. 28, 2021 (pp. 1-6).
Response to Election of Species for U.S. Appl. No. 16/426,057 dated Jun. 16, 2020 (pp. 1-2).
Response to Election of Species for U.S. Appl. No. 16/937,043 dated Jun. 21, 2021 (pp. 1-2).
Response to Office Action for U.S. Appl. No. 16/937,043 dated Sep. 30, 2021 (pp. 1-1).
U.S. Appl. No. 16/426,050, filed May 30, 2019.
U.S. Appl. No. 16/426,057, filed May 30, 2019.
U.S. Appl. No. 16/426,060, filed May 30, 2019.
U.S. Appl. No. 16/426,063, filed May 30, 2019.
U.S. Appl. No. 16/426,066, filed May 30, 2019.
U.S. Appl. No. 16/562,957, filed Sep. 6, 2019.
U.S. Appl. No. 16/598,282, filed Oct. 10, 2019.
U.S. Appl. No. 16/829,346, filed Mar. 25, 2020.
U.S. Appl. No. 16/937,043, filed Jul. 23, 2020.
U.S. Appl. No. 17/036,775, filed Sep. 29, 2020.
U.S. Appl. No. 17/118,999, filed Dec. 11, 2020.
U.S. Appl. No. 17/119,016, filed Dec. 11, 2020.
U.S. Appl. No. 17/119,040, filed Dec. 11, 2020.
U.S. Appl. No. 17/231,368, filed Apr. 15, 2021.
U.S. Appl. No. 17/245,583, filed Apr. 30, 2021.
U.S. Appl. No. 17/478,025, filed Sep. 17, 2021.
U.S. Appl. No. 17/487,113, filed Sep. 28, 2021.
U.S. Appl. No. 17/487,131, filed Sep. 28, 2021.
U.S. Appl. No. 17/487,141, filed Sep. 28, 2021.
U.S. Appl. No. 17/487,262, filed Sep. 28, 2021.
U.S. Appl. No. 17/573,911, filed Jan. 12, 2022.
U.S. Appl. No. 29/692,992, filed May 30, 2019.
U.S. Appl. No. 29/692,993, filed May 30, 2019.
U.S. Appl. No. 29/692,994, filed May 30, 2019.
U.S. Appl. No. 29/692,996, filed May 30, 2019.
U.S. Appl. No. 29/692,997, filed May 30, 2019.

* cited by examiner 105
135b
148b
131b
139b
138b
148b
133b
T
T
T

CARRIER FOR CONTAINERS

CROSS-REFERENCE TO RELATED APPLICATIONS

This application is a continuation application of U.S. patent application Ser. No. 17/478,025, filed on Sep. 17, 2021, which is a continuation application of U.S. patent application Ser. No. 16/426,066, filed on May 30, 2019, now U.S. Pat. No. 11,180,301, which claims the benefit of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, and U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, and U.S. Provisional Patent Application No. 62/841,449, filed on May 1, 2019.

INCORPORATION BY REFERENCE

The disclosures of each of U.S. patent application Ser. No. 17/478,025, filed on Sep. 17, 2021, U.S. patent application Ser. No. 16/426,066, filed on May 30, 2019, U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, and U.S. Provisional Patent Application No. 62/841,449, filed on May 1, 2019, are hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers that comprises a plurality of panels comprising at least two central panels and at least one attachment panel configured to receive a portion of one or more containers of the plurality of containers. The at least two central panels comprise a first central panel foldably connected to a second central panel. The first central panel comprises at least one opening and a portion of the second central panel is exposed through the at least one opening when the first central panel and the second central panel are in at least partial face-to-face contact.

According to another aspect of the disclosure, a blank for forming a carrier for holding a plurality of containers comprises a plurality of panels comprising at least two central panels and at least one attachment panel configured to receive a portion of one or more containers of the plurality of containers. The at least two central panels comprise a first central panel foldably connected to a second central panel. The first central panel comprises at least one opening and a portion of the second central panel is for being exposed through the at least one opening when the first central panel and the second central panel are in at least partial face-to-face contact when the carrier is formed from the blank.

According to another aspect of the disclosure, a method of forming a carrier for holding a plurality of containers comprises obtaining a blank comprising a plurality of panels comprising at least two central panels and at least one attachment panel configured to receive a portion of one or more containers of the plurality of containers. The at least two central panels comprise a first central panel foldably connected to a second central panel, the first central panel comprises at least one opening. The method comprises folding the plurality of panels such that the first central panel and the second central panel are in at least partial face-to-face contact and a portion of the second central panel is exposed through the at least one opening.

According to another aspect of the disclosure, a package comprises a plurality of containers and a carrier for holding the plurality of containers. The carrier comprises a plurality of panels comprising at least two central panels and at least one attachment panel receiving a portion of one or more containers of the plurality of containers. The at least two central panels comprise a first central panel foldably connected to a second central panel. The first central panel comprises at least one opening. The first central panel and the second central panel are in at least partial face-to-face contact and a portion of the second central panel is exposed through the at least one opening.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
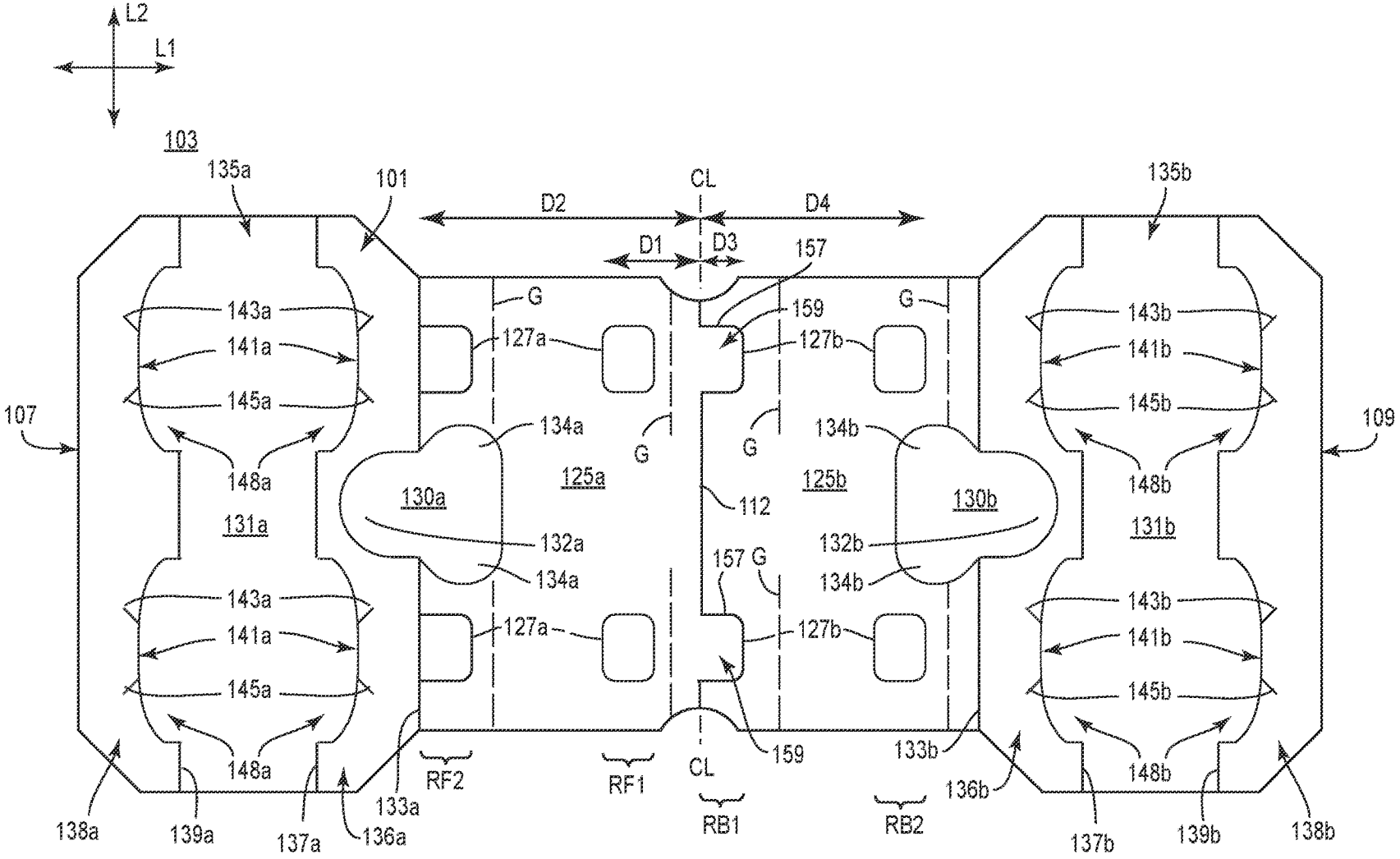
FIG. 1 is a plan view of an outer surface of a blank for forming a carrier according to a first exemplary embodiment of the disclosure.
Figure 5:
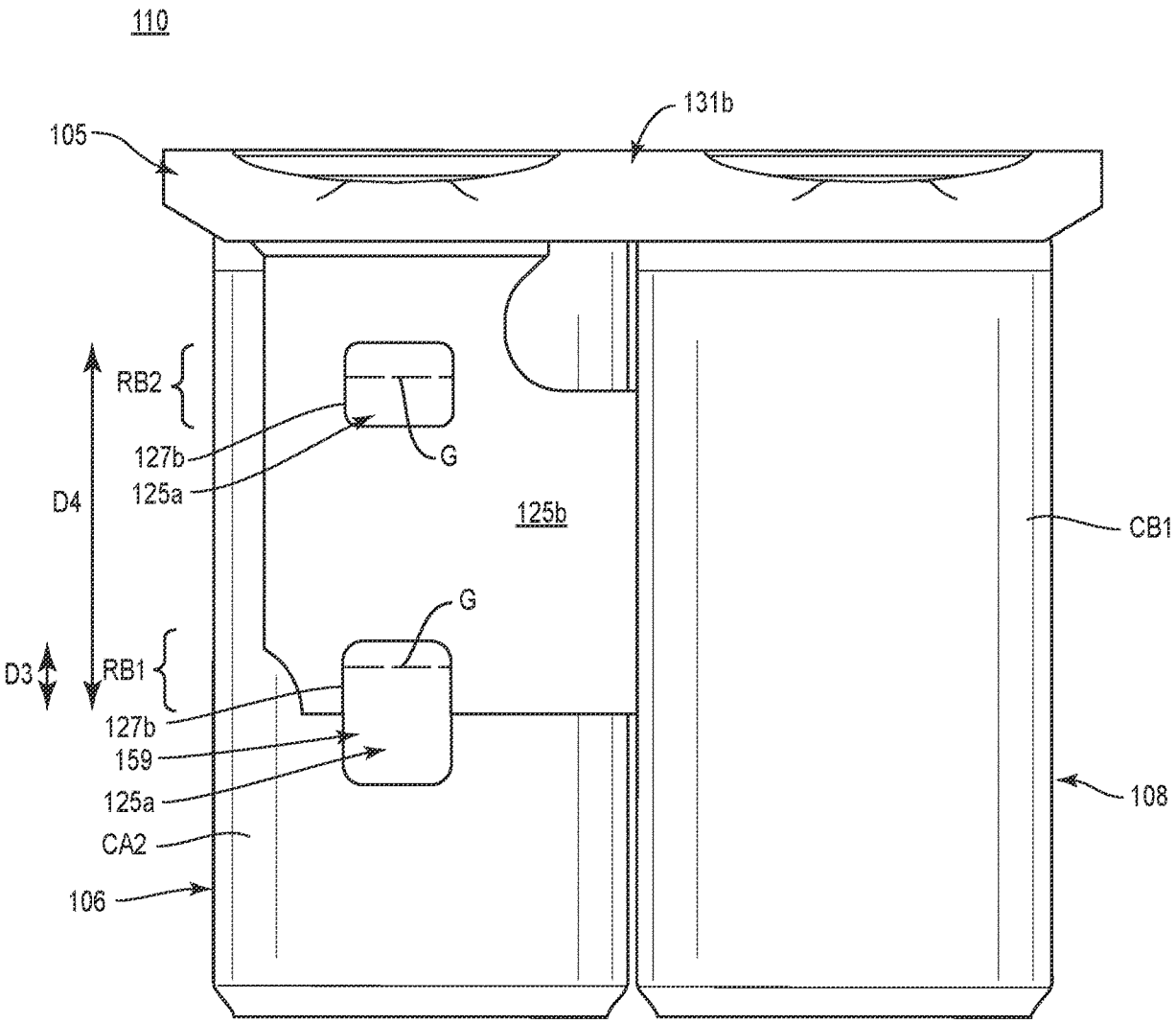
FIG. 5 is a rear view of the carrier of FIG. 4 and having a container removed therefrom.
Figure 6:
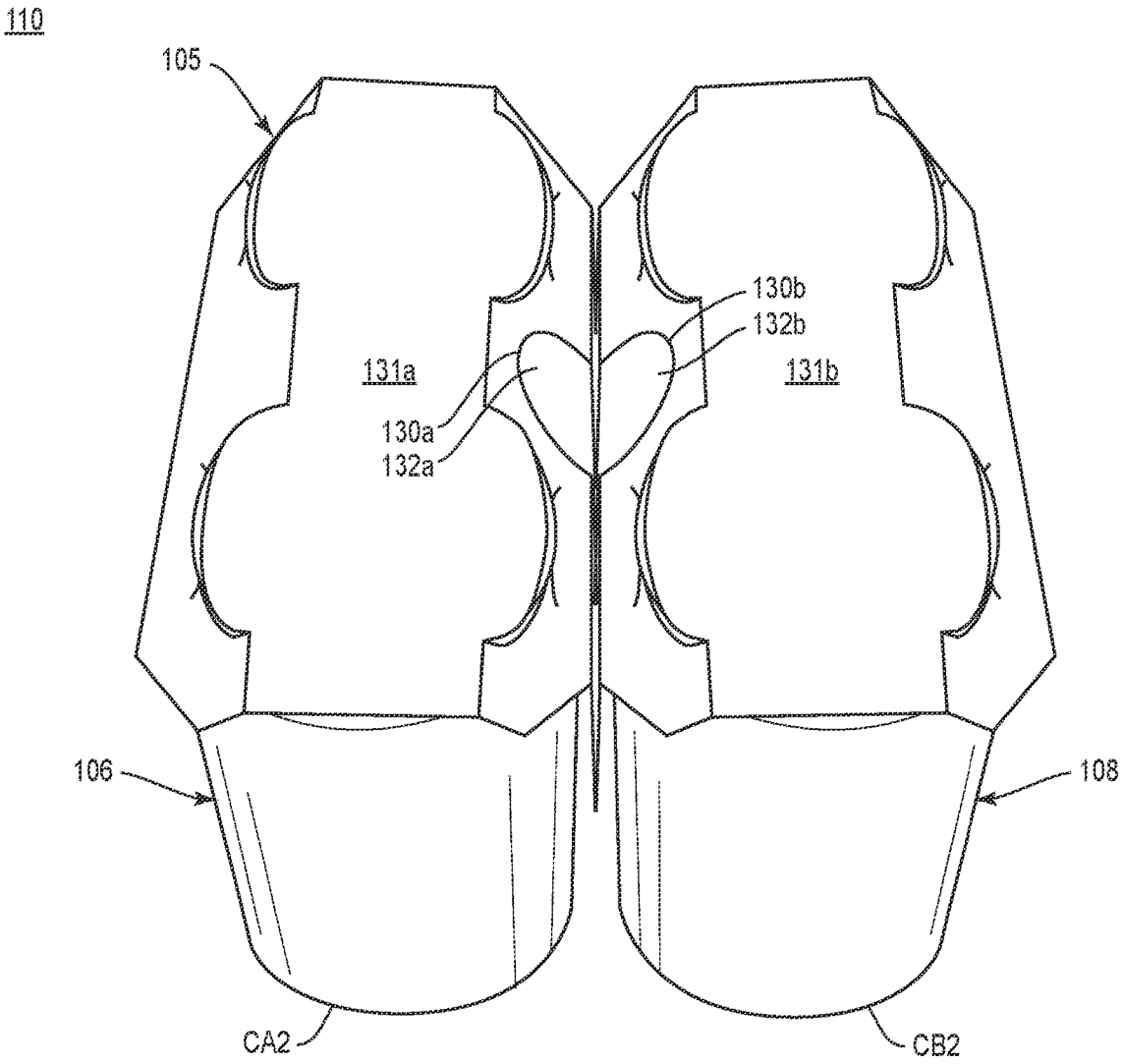
FIG. 6 is a perspective view of a package and carrier formed from the blank of FIG. 1 according to the first exemplary embodiment.

FIG. 1 shows a plan view of an exterior side 101 of a blank 103 used to form a carrier 105 (FIG. 6) in accordance with a first exemplary embodiment of the disclosure. As shown in FIG. 5, the carrier 105 is sized to contain or support four containers, with two containers CA1, CA2 being attached to a front portion 106 of the carrier 105 and two containers CB1, CB2 being attached to a back portion 108 of the carrier 105. In the illustrated embodiment, the containers CA1, CA2, CB1, CB2, can be beverage cans, or could be any other suitable type and size of container without departing from the disclosure. The carrier 105 can be sized and shaped to hold more or less than four containers. In one embodiment, the front portion 106 and the back portion 108 of the carrier 105 each have two containers, and in other embodiments, the front portion 106 and the back portion 108 of the carrier 105 can carry more or less than two containers without departing from the disclosure. The carrier 105 can be provided together with one or more containers as a package 110 (FIG. 6).

As shown in FIG. 1, the blank 103 has a longitudinal axis L1 and a lateral axis L2. The blank 103 has a front portion 107 for forming the front portion 106 of the carrier 105, and a back portion 109 for forming the back portion 108 of the carrier 105. The front portion 107 and the back portion 109 of the blank 103 are foldably connected at a lateral fold line 112 that forms a lateral centerline CL of the blank 103, as shown. As discussed further below, the blank 103 is at least partially formed into the carrier 105 by folding the blank 103 at the fold line 112 along the centerline CL so that the front portion 107 and the back portion 109 of the blank 103 are overlapped in at least partial face-to-face contact.

In the illustrated embodiment, the front portion 107 of the blank 103 comprises a front central panel 125*a* having a first front row RF1 of laterally spaced adhesive or glue openings 127*a*, and a second front row RF2 of the laterally spaced adhesive or glue openings 127*a*. The top edges of the respective glue openings 127*a* of the first row RF1 are spaced a longitudinal distance D1 apart from the fold line 112 that is less than a longitudinal distance D2 that the top edges of the respective glue openings 127*a* of the second row RF2 are spaced apart from the fold line 112. As shown, the top edges of the glue openings 127*a* of the second row RF2 can interrupt the fold line 133*a*.

A front container retention panel or front attachment panel 131*a* is foldably connected to the front central panel 125*a* at a lateral fold line 133*a*, and includes a container retention portion 135*a* that is at least partially defined between a pair of longitudinally-spaced lateral fold lines 137*a*, 139*a* that are each interrupted by a respective pair of longitudinally-spaced cuts 141*a* that can each include one or more curved and/or angled portions. As shown, the longitudinally-spaced cuts 141*a* define container retention tabs 148*a* that extend outwardly from the container retention portion 135*a*. As also shown, respective oblique cuts 143*a*, 145*a* extend outwardly from each respective cut 141*a* to define a plurality of reconfigurable edges of the front attachment panel 131*a* that face the respective container retention tabs 148*a*.

As shown, an interior marginal portion 136*a* of the attachment panel 131*a* is defined between the fold lines 137*a*, 133*a*, and an exterior marginal portion 138*a* of the attachment panel 131*a* is defined between the fold line 139*a* and a free edge of the attachment panel 131*a*.

The blank 103 can include handle features that include at least a handle opening 130*a* that interrupts the fold line 133*a* and extends from a portion of the front central panel 125*a* into a portion of the front attachment panel 131*a*. As shown, the handle opening 130*a* can include a longitudinal section 132*a* extending parallel to the longitudinal axis L1 and a pair of lateral sections 134*a* that intersect and diverge orthogonally away from the longitudinal section 132*a* in substantial parallel relation with the lateral axis L2. In this regard, the sections 132*a*, 134*a* of the handle opening 130*a* are in communication with one another. As described further herein, the sections 132*a*, 134*a* of the handle opening 130*a* provide multiple engagement surfaces at which a consumer can grasp the carrier 105, in different orientations. The carrier 105 can have a different arrangement of handle features, or can be devoid of handle features, without departing from the disclosure.

In the illustrated embodiment, the back portion 109 of the blank 103 includes a back central panel 125*b* and a back container retention panel or back attachment panel 131*b* having associated features that are generally a mirror-image of the corresponding panels and flaps of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103.

As shown, a pair of generally U-shaped cuts 157 interrupt the fold line 112 and extend from the centerline CL to define a pair of tabs 159 that protrude from the front central panel 125*a*. As described further herein, a lateral portion of the respective cuts 157 defines the top edge of respective glue openings 127*b* of a first back lateral row RB1 of laterally spaced glue openings 127*b*. As shown, the top edges of the respective glue openings 127*b* of the first lateral row RB1 of glue openings 127*b* are spaced a longitudinal distance D3 apart from the fold line 112 that is less than a longitudinal distance D4 that the top edges of respective glue openings 127*b* of a second back lateral row RB2 of glue openings 127*b* are spaced apart from the fold line 112.

In this regard, the blank 103 is provided with front rows RF1 and RF2 of laterally-spaced front glue openings 127*a* that are spaced respective longitudinal distances D1, D2 from the centerline CL, and back rows RB1 and RB2 of laterally-spaced back glue openings 127*b* that are spaced respective longitudinal distances D3, D4 from the centerline CL. The glue openings 127*a*, 127*b* have a longitudinally staggered arrangement such that D2>D4>D1>D3. Upon formation of the carrier 105 from the blank 103, the longitudinal centerline CL/fold line 112 can form a bottom edge of the central panels 125*a*, 125*b*.

As described herein, the arrangement of the glue openings 127*a*, 127*b* is such that, upon erection of the carrier 105, the glue openings 127*a*, 127*b* provide access to a respective plurality of surfaces of the respective central panels 125*b*, 125*a* upon which the respective containers CA1, CA2, CB1, CB2 can be attached to enhance retention and support of the containers CA1, CA2, CB1, CB2 by the carrier 105.

Any of the panels, flaps, fold lines, cuts, or other features could be otherwise shaped, arranged, and/or omitted from the blank 103 without departing from the disclosure. The blank 103 could be sized and/or shaped to accommodate more or less than four containers without departing from this disclosure.

Figure 2:
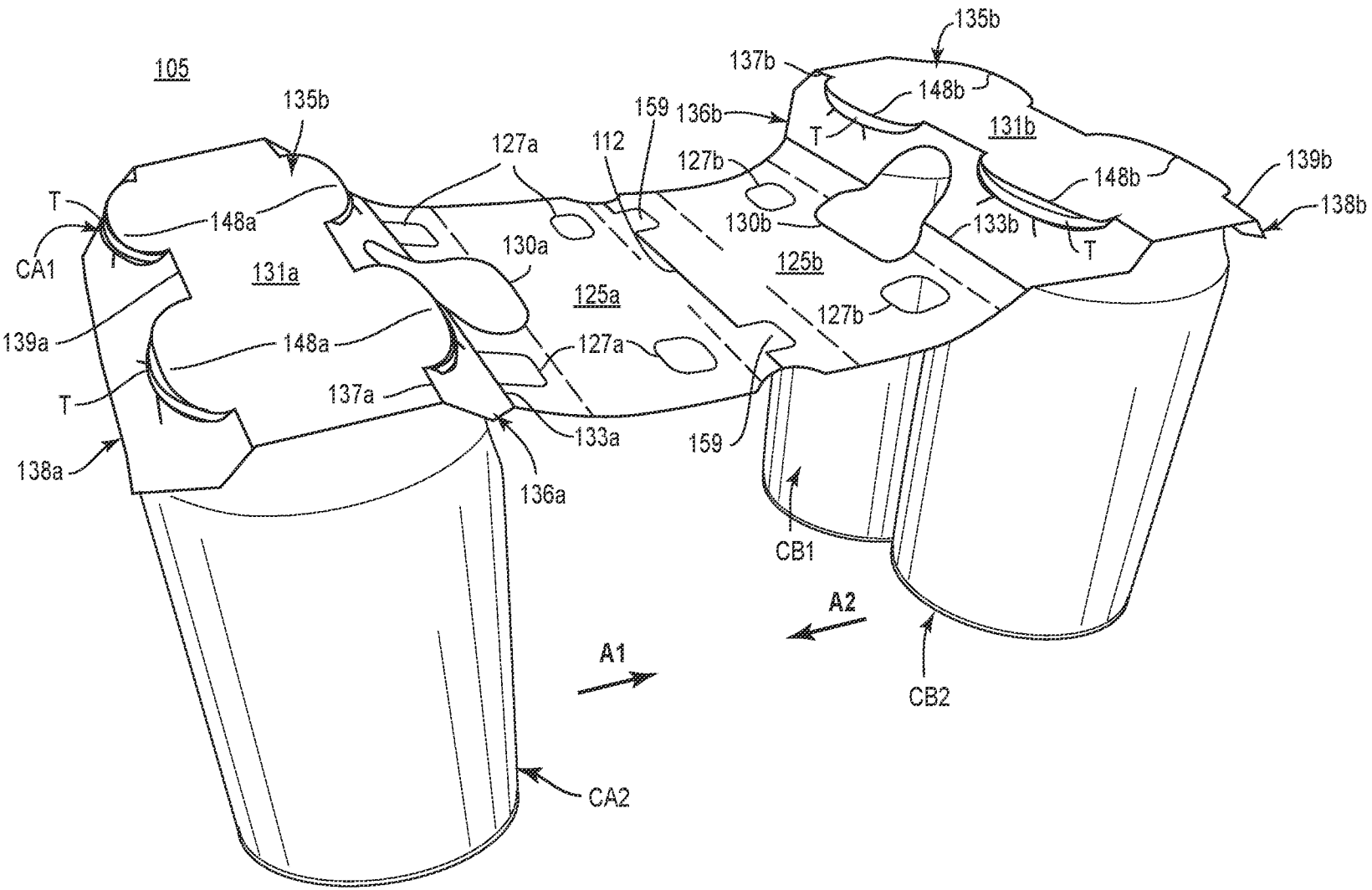
FIG. 2 is a perspective view of a partially folded configuration of a carrier formed from the blank of FIG. 1 according to the first exemplary embodiment.

As shown in FIG. 2, an interior surface or underside of the blank 103 can be placed atop the containers CA1, CA2, CB1, CB2 such that the container retention portion 135*a* of the front attachment panel 131*a* overlies the containers CA1, CA2 and such that the container retention portion 135*b* of the back attachment panel 131*b* overlies the containers CB1, CB2. Further downward positioning of the attachment panels 131*a*, 131*b* over the plurality of containers CA1, CA2, CB1, CB2 can activate the respective container retention portions 135*a*, 135*b* to engage respective containers. For example, as the front attachment panel 131*a* is lowered or urged downwardly onto the containers CA1, CA2, the container retention portion 135*a* can at least partially separate from the remainder of the front attachment panel 131*a* at the cuts 141*a*. In such an arrangement, upper or top portions T of the respective containers CA1, CA2 can extend at least partially through respective openings formed by the respective cuts 141*a* such that the container retention tabs 148*a* can engage, for example, a recessed portion of a rim or other top structure of the respective container CA1, CA2, and such that a plurality of reconfigurable edges of the exterior marginal portion 138*a* can engage, for example, a rolled rim edge or other top structure of the respective container CA1, CA2.

Such reconfiguration of the corresponding portions of the back attachment panel 131*b* can occur as the back attachment panel 131*b* is lowed or urged downwardly onto the containers CB1, CB2. During the above-described engagement of the respective container retention portions 135*a*, 135*b* with the respective containers, the marginal portions 136*a*, 138*a* of the attachment panel 131*a* can fold at least partially downwardly at the respective fold lines 137*a*, 139*a* in such a configuration, and, similarly, the marginal portions 136*b*, 138*b* of the attachment panel 131*b* can fold at least partially downwardly at the respective fold lines 137*b*, 139*b*.

Figure 3:
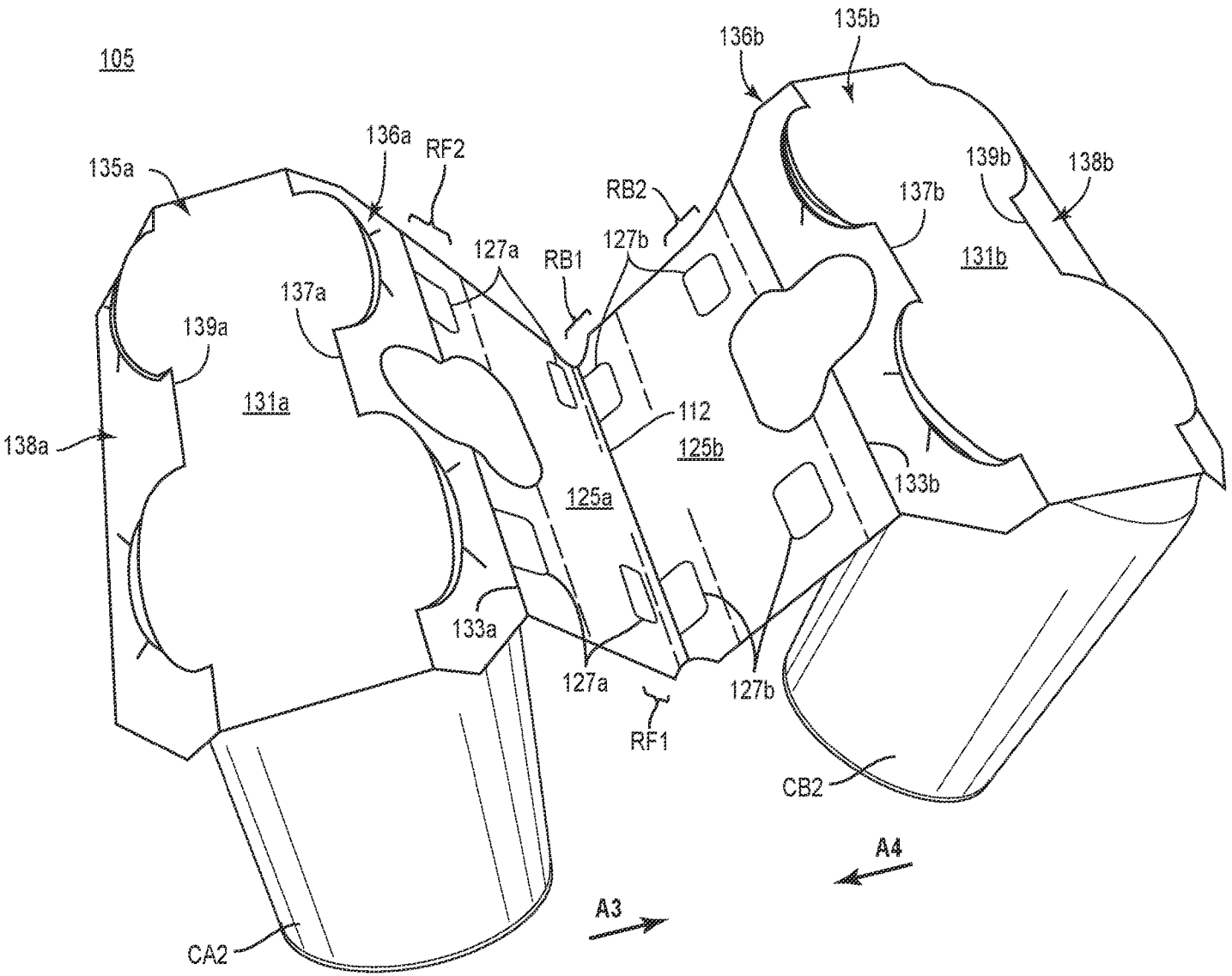
FIG. 3 is a perspective view of another partially folded configuration of a carrier formed from the blank of FIG. 1 according to the first exemplary embodiment.

As also shown in FIG. 2, the front central panel 125*a* and the back central panel 125*b* can be folded at the fold line 112 in the direction of the arrows A1, A2 such that the front central panel 125*a* and the back central panel 125*b* are brought into at least partial face-to-face contact in the direction of the respective arrows A3, A4 (FIG. 3) to be positioned between respective adjacent containers and such that the respective glue openings 127*a*, 127*b* are positioned so as to be laterally aligned but longitudinally offset due to the different relative spacing of the respective rows RF1, RF2 of front glue openings 127*a* and the respective rows RB1, RB2 of back glue openings 127*b* away from the fold line 112 as described above.

In this regard, the central panels 125*a*, 125*b* are arranged such that a portion of the front central panel 125*a* overlaps each of the glue openings 127*b* and a portion of the back central panel 125*b* overlaps each of the glue openings 127*a* to provide communication between the central panels 125*a*, 125*b* and respective surfaces upon which the respective containers CA1, CA2, CB1, CB2 can be adhered or otherwise attached, as described further herein. Such rearrangement of the central panels 125*a*, 125*b* can also cause the respective central panels 125*a*, 125*b* to be folded downwardly relative to the respective attachment panels 131*a*, 131*b* at the respective fold lines 133*a*, 133*b*.

Figure 4:
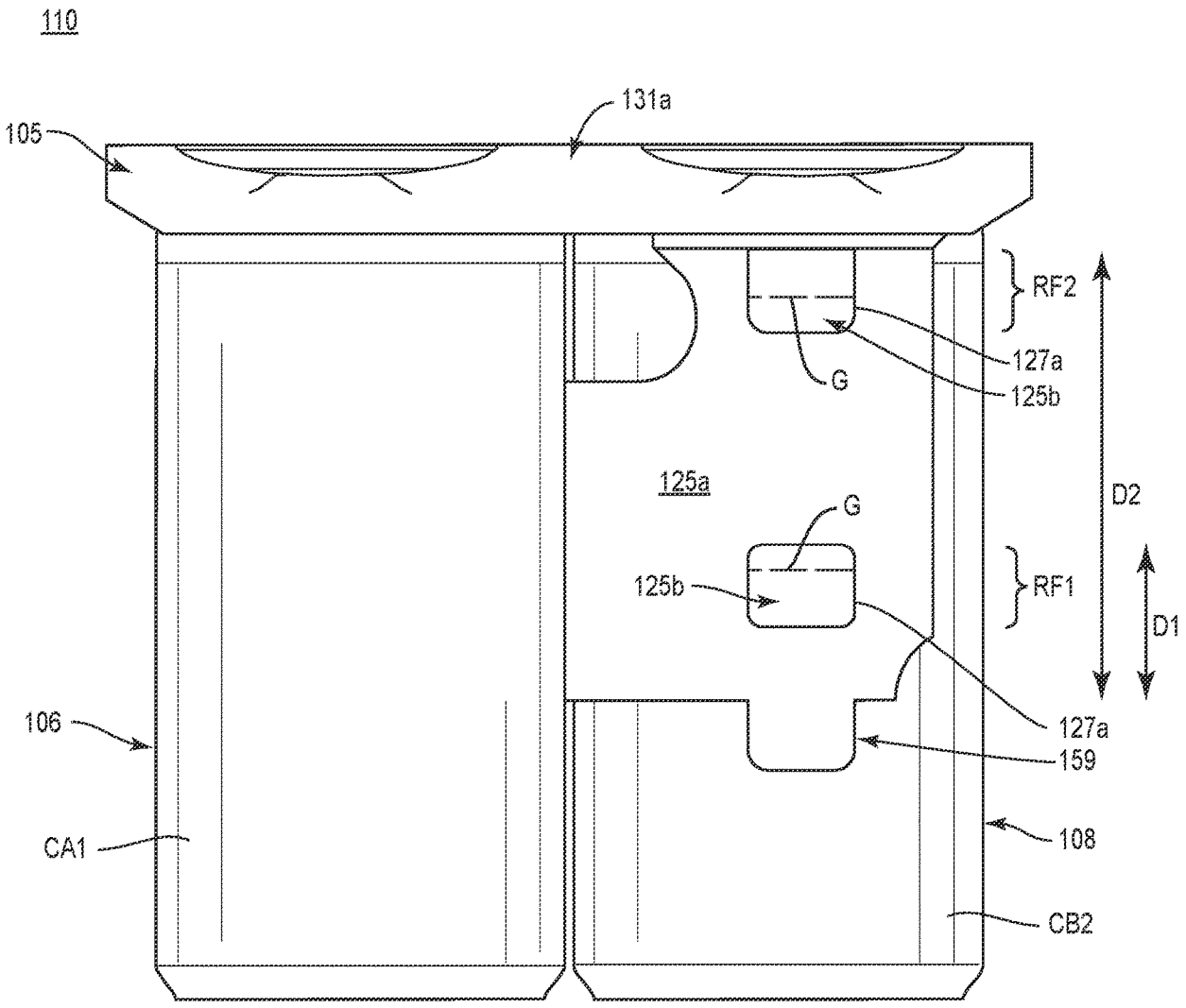
FIG. 4 is a front view of a carrier formed from the blank of FIG. 1 according to the first exemplary embodiment and having a container removed therefrom.

Referring to FIGS. 4 and 5, in which the respective containers CA2, CB1 are removed for clarity of illustration, an adhesive glue G can be provided to adhere the containers CA1, CA2 to respective portions of the central panel 125*b* exposed through the respective glue openings 127*a*, and the glue G can be provided to adhere the containers CB1, CB2 to respective portions of the central panel 125*a* exposed through the respective glue openings 127*b*. The arrangement of multiple rows of respective glue openings 127*a*, 127*b* provides multiple points of attachment of each respective container to the respective opposite central panel 125*a*, 125*b* such that each container is provided with a robust attachment to a respective central panel 125*a*, 125*b*. The attachment of the containers CA1, CA2, CB1, CB2 to the respective central panel 125*a*, 125*b* can provide retention and support of the respective containers, e.g., such that the containers do not detach from the carrier 105 under their own weight, in addition to or alternative to the container retention and support provided by the respective container retention portions 135*a*, 135*b*. For example, in one embodiment, one or more of the containers CA1, CA2, CB1, CB2 can be attached to a respective central panel 125*a*, 125*b* with glue G, without additional retention and support provided by a container retention portion as described above.

The glue G described herein can be, for example, a hot melt adhesive, a high tack glue, an epoxy, a polymeric cement, etc., or combinations thereof. The glue G can have a different arrangement without departing from the disclosure. For example, in one embodiment, the glue G can be applied to one or more portions of the interior surface of the blank 103/carrier 105.

Such enhanced attachment of the respective containers to the respective central panels 125*a*, 125*b* with the glue G can also provide enhanced integrity to the carrier 105, e.g., by providing opposing adhesive forces on the respective central panels 125*a*, 125*b* such that the central panels 125*a*, 125*b* are compressed therebetween. For example, in one embodiment, as the carrier 105 is lifted, the containers CA1, CA2 can at least partially pull the portions of the back central panel 125*b* to which they are attached through the respective glue openings 127*a* toward the front central panel 125*a* under the at least partial weight of the containers CA1, CA2. Respective portions of the front central panel 125*a* can be pulled toward the back central panel 125*b* through the respective glue openings 127*b* by the containers CB1, CB2 in a similar manner.

Figure 7:
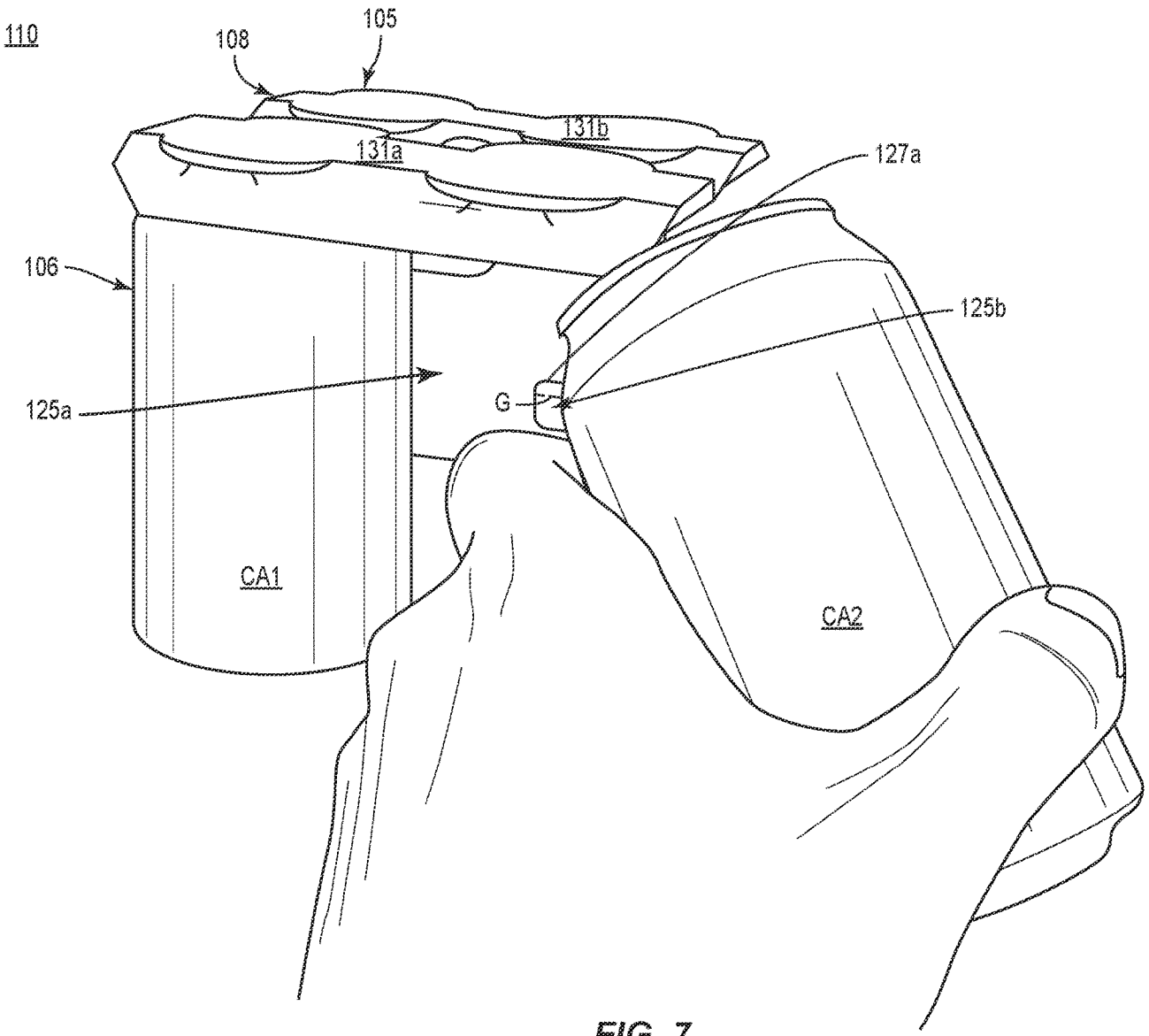
FIG. 7 is another perspective view of the package and carrier of FIG. 6 and showing a container being removed therefrom.

Referring additionally to FIGS. 6 and 7, a respective container CA1, CA2, CB1, CB2 can be removed from the carrier 105 by disengaging the container from a respective attachment panel 131*a*, 131*b*, for example, by withdrawing the top portion T of a respective container through an opening formed by a respective cut 141*a*, 141*b* along the respective attachment panel 131*a*, 131*b*, and peeling the respective container away from the respective central panel 125*a*, 125*b*. Peeling or pulling the containers CA1, CA2, CB1, CB2 away from a respective central panel 125*a*, 125*b* can involve pulling the respective container with a force sufficient to overcome the adhesive bond of the respective container and the respective central panel 125*a*, 125*b* provided by the glue G. In one embodiment, the glue G can be selected so as to remain on a respective central panel 125*a*, 125*b*, e.g., such that substantially little or no glue G remains on the container as it is removed. One or more of the containers CA1, CA2, CB1, CB2, in one embodiment, can be reattached to a respective central panel 125*a*, 125*b* following therefrom by pressing the container against a respective region of glue G.

It will be understood that a different number of rows or arrangements of glue openings can be provided without departing from the disclosure, and that the central panels can be sized and configured to accommodate such arrangements. In one embodiment, the central panels 125*a*, 125*b* can be devoid of glue openings such that the respective containers CA1, CA2 and CB1, CB2 are adhered only to the respective central panel 125*a*, 125*b*. In another embodiment, glue G can be provided both on portions of the respective central panels 125*a*, 125*b* exposed through the respective glue openings 127*b*, 127*a* as well as portions of the respective central panels 125*a*, 125*b* adjacent the respective glue openings 127*a*, 127*b* such that each container CA1, CA2, CB1, CB2 can be adhered to portions of both central panels 125*a*, 125*b*.

Still referring to FIGS. 6, the carrier 105 can be grasped by a consumer by inserting one or more of his or her fingers in either or both handle openings 130*a*, 130*b* and engaging, for example, a portion of an underside of a respective attachment panel 131*a*, 131*b* and/or an edge of the respective handle openings 130*a*, 130*b*. The divergent nature of the respective longitudinal sections 132*a*, 132*b* and the respective lateral sections 134*a*, 134*b* of the respective handle openings 130*a*, 130*b* allows a consumer multiple edges and surfaces by which to engage and lift the carrier 105 such that the consumer can engage the carrier from multiple orientations, e.g., a lateral orientation or a longitudinal orientation, or orientations therebetween.

The carrier 105/package 110 described above has a compact structure that can, for example, provide materials savings and waste reduction. Additionally, the arrangement of the glue G among the containers CA1, CA2, CB1, CB2 as well as the central panels 125*a*, 125*b* provides multiple points of attachment that results in a robust structure for holding and carrying the containers CA1, CA2, CB1, CB2. Further, the exposure of one or more portions of the containers CA1, CA2, CB1, CB2 on exterior portions of the carrier 105/package 110 provides a consumer with a clear view of labeling or surface graphics associated with the containers CA1, CA2, CB1, CB2, as well as providing convenient access to remove one or more of the containers CA1, CA2, CB1, CB2 from the carrier 105/package 110.

Figure 8:
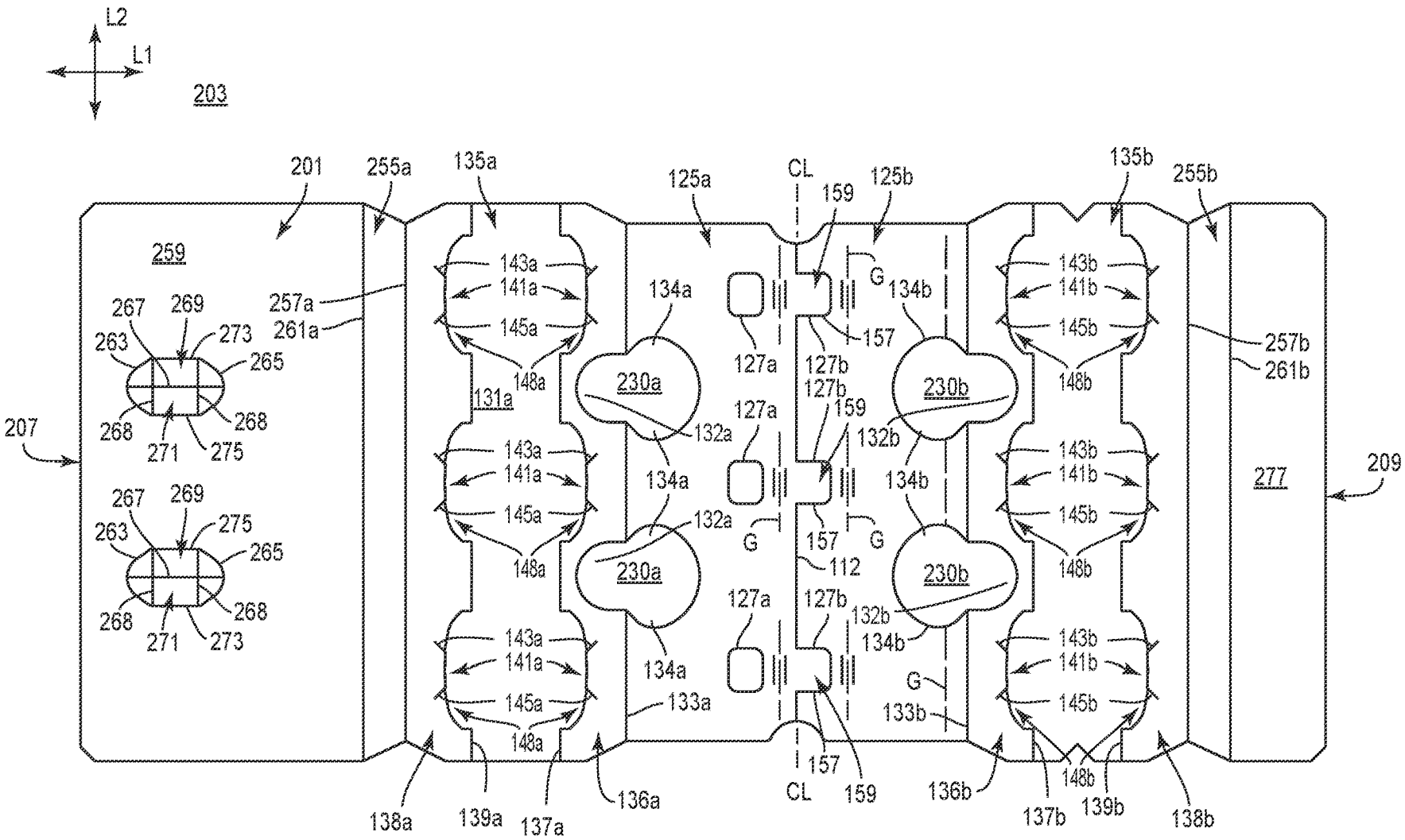
FIG. 8 is a plan view of an outer surface of a blank for forming a carrier according to a second exemplary embodiment of the disclosure.
Figure 9:
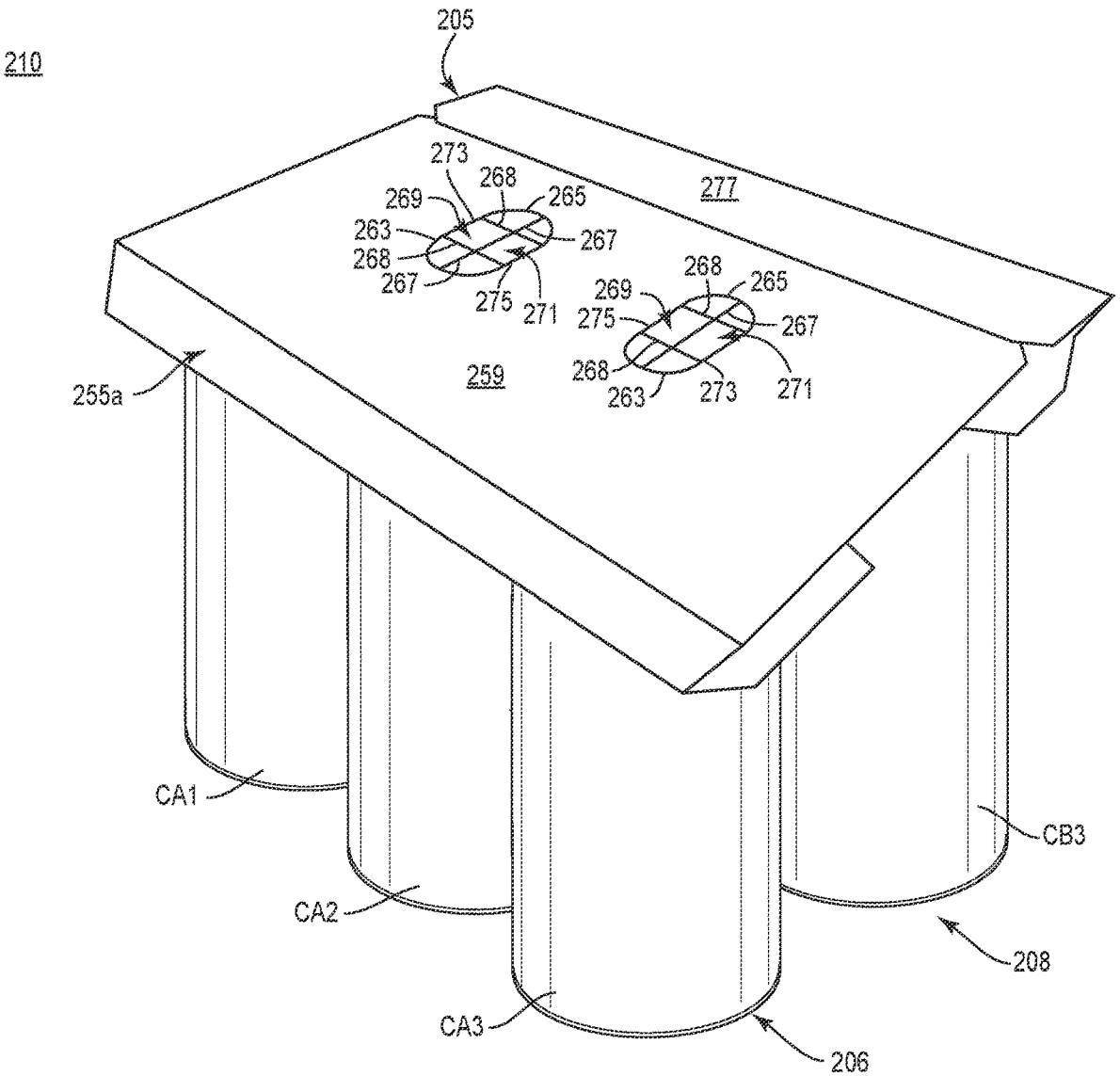
FIG. 9 is a perspective view of a package and carrier formed from the blank of FIG. 8 according to the second exemplary embodiment.

Referring additionally to FIGS. 8 and 9, a blank 203 for forming a carrier 205 according to a second exemplary embodiment of the disclosure is illustrated. The blank 203 and the carrier 205 can have one or more features that are similar to those of the blank 103 and the carrier 105 of the first exemplary embodiment, and like or similar reference numbers refer to like or similar features.

As shown, the attachment panels 131*a*, 131*b* of the blank 203 are each provided with a respective three laterally spaced cuts 141*a*, 141*b* such that the carrier 205 is sized and configured to support and retain six containers, with three containers CA1, CA2, CA3 in a front portion 206 of the carrier 205 and three containers CB1, CB2, CB3 in a back portion 208 of the carrier 205.

The blank 203 includes a pair of handle openings 230*a* (broadly, respective "first handle opening" and "second handle opening") that extend from a portion of the front attachment panel 131*a* and into the front central panel 125*a*, and a pair of handle openings 230*b* that extend from a portion of the back attachment panel 131*b* and into the back central panel 125*b*. As shown, the respective handle openings 230*a*, 230*b* have the respective longitudinal section 132*a*, 132*b* and the respective lateral sections 134*a*, 134*b*. As also shown, the central panels 125*a*, 125*b* each include a single lateral row of respective glue openings 127*a*, 127*b*, though the central panels 125*a*, 125*b* of the blank 203 can be provided with a different number or arrangement of glue openings and rows thereof without departing from the disclosure.

The blank 203 additionally includes a bevel or front side panel 255*a* that is foldably connected to the front attachment panel 131*a* at a lateral fold line 257*a*, and a top panel 259 that is foldably connected to the front side panel 255*a* at a lateral fold line 261*a*. The top panel 259, as shown, includes a pair of handle features (broadly, "first handle feature" and "second handle feature", respectively) that each include a pair of opposed curved cuts 263, 265 and a longitudinal cut 267 extending from the curved cut 263 to the curved cut 265 to define a pair of handle flaps 269, 271 that are foldably connected to the top panel 259 at respective lateral fold lines 273, 275. A pair of lateral lines of weakening 268 extend along a portion of each flap 269, 271 so as to provide an at least partially reconfigurable arrangement, as described further herein. Handle features of the carrier 205 include the handle features in the top panel 259, and can also include the handle openings 230*a*, 230*b*. The carrier 205 can have a different arrangement of handle features, or can be devoid of handle features, without departing from the disclosure.

The back portion 209 of the blank 203 additionally includes a back side panel 255*b* foldably connected to the back attachment panel 131*b* at a lateral fold line 257*a*, and an attachment flap 277 foldably connected to the back side panel 255*b* at a lateral fold line 261*b*.

The carrier 205 and a package 210 that includes the carrier 205 and the containers CA1, CA2, CA3, CB1, CB2, CB3 can be formed in a similar manner as that described above with respect to the carrier 105/package 110, and, additionally, the front side panel 255*a* can be folded upwardly at the fold line 257*a*, for example, to be at an oblique arrangement relative to the containers CA1, CA2, CB1, CB2, and the top panel 259 can be folded at the fold line 261*a* in the into at least partial face-to-face contact with at least a portion of the attachment panels 231*a*, 231*b*, as shown in FIG. 9. Similarly, the back side panel 255*b* can be folded upwardly at the fold line 257*b* into an oblique arrangement with the containers CA1, CA2, CB1, CB2, and the attachment flap 277 can be folded at the fold line 261*b* into at least partial face-to-face contact with the top panel 259 and/or the attachment panel 231*b*, as shown in FIG. 9. Such an arrangement can be maintained with an adhesive such as glue.

Still referring to FIG. 9, the respective handle flaps 269, 271 can be at least partially separated from the top panel 259 at the respective cuts 263, 265, and from each other at the respective cuts 267, and folded downwardly at the respective fold lines 273, 275 into an interior portion of the carrier 205/package 210. The handle openings 230*a*, 230*b* provide clearance for the handle flaps 269, 271 to extend downwardly in such an arrangement and the lateral fold lines 268 of each respective handle flap 269, 271 can provide the respective handle flap 269, 271 with a reconfigurable arrangement so as to, for example, contour or angle against one or more of the respective containers CA1, CA2, CA3, CB1, CB2, CB3, e.g., such that at least a central portion of the respective handle flaps 269, 271 defined between the respective fold lines 268 can be positioned between adjacent containers. Further, the marginal portions of the respective handle flaps 269, 271 defined by the respective fold lines 268 can at least partially wrap around or surround a consumer's finger, for example, to minimize or prevent contact of the consumer's finger with edges or corners of the carrier 205/package 210 and/or the respective containers. In addition, and as described above, the divergent nature of the respective longitudinal sections 132*a*, 132*b* and the respective lateral sections 134*a*, 134*b* of the respective handle openings 230*a*, 230*b* allows a consumer multiple edges and surfaces by which to engage and lift the carrier 205 such that the consumer can engage the carrier from multiple orientations, e.g., a lateral orientation or a longitudinal orientation, or orientations therebetween.

It will be understood that the blanks and carriers described herein can be provided in different configurations without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising at least two central panels and at least one attachment panel, the at least one attachment panel including a pair of retention tabs configured to engage a rim of one or more containers of the plurality of containers, the at least two central panels comprise a first central panel foldably connected to a second central panel, the at least one attachment panel directly connected to one of the first central panel and the second central panel, the first central panel comprises at least one opening and a portion of the second central panel is exposed through the at least one opening when the first central panel and the second central panel are in at least partial face-to-face contact.

2. The carrier of claim 1, wherein the second central panel is for being adhered to the at least one container of the plurality of containers.

3. The carrier of claim 2, wherein adhesive is applied to the portion of the second central panel.

4. The carrier of claim 1, wherein the at least one opening comprises a plurality of openings comprising a first row of openings and a second row of openings spaced apart from the first row of openings.

5. The carrier of claim 4, wherein the first row of openings is spaced a first distance from a bottom edge of the first central panel, and the second row of openings is spaced a second distance from the bottom edge of the first central panel, the second distance is greater than the first distance.

6. The carrier of claim 4, wherein the first central panel is a front central panel and the second central panel is a back central panel, the at least one attachment panel is a front attachment panel directly connected to the front central panel, and the plurality of panels further comprises a back attachment panel directly connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

7. The carrier of claim 6, wherein the first plurality of openings are offset from the second plurality of openings.

8. The carrier of claim 1, wherein the plurality of panels further comprises a top panel overlying at least a portion of the at least one attachment panel, the top panel comprises at least one handle feature.

9. The earner of claim 1, wherein the at least one attachment panel comprising a container retention portion, an exterior marginal portion foldably connected to the container retention portion, and an interior marginal portion foldably connected to each of the container retention portion and one of the first central panel and the second central panel.

10. The carrier of claim 9, wherein the interior marginal portion extends obliquely from the container retention portion to the one of the first central panel and the second central panel.

11. A blank for forming a carrier for holding a plurality of containers, the blank comprising:

a plurality of panels comprising at least two central panels and at least one attachment panel, the at least one attachment panel including a pair of retention tabs configured to engage a rim of one or more containers of the plurality of containers, the at least two central panels comprise a first central panel foldably connected to a second central panel, the at least one attachment panel directly connected to one of the first central panel and the second central panel, the first central panel comprises at least one opening and a portion of the second central panel is for being exposed through the at least one opening when the first central panel and the second central panel are in at least partial face-to-face contact when the carrier is formed from the blank.

12. The blank of claim 11, wherein the second central panel is for being adhered to the at least one container of the plurality of containers when the carrier is formed from the blank.

13. The blank of claim 12, wherein adhesive is applied to the portion of the second panel when the carrier is formed from the blank.

14. The blank of claim 11, wherein the at least one opening comprises a plurality of openings comprising a first row of openings and a second row of openings spaced apart from the first row of openings.

15. The blank of claim 14, wherein the first central panel is foldably connected to the second central panel at a fold line, the first row of openings is spaced a first distance from the fold line, and the second row of openings is spaced a second distance from the fold line, the second distance is greater than the first distance.

16. The blank of claim 14, wherein the first central panel is a front central panel and the second central panel is a back central panel, the at least one attachment panel is a front attachment panel directly connected to the front central panel, and the plurality of panels further comprises a back attachment panel directly connected to the back central panel, the plurality of openings is a first plurality of openings in the front central panel, and the back central panel comprises a second plurality of openings.

17. The blank of claim 16, wherein the first plurality of openings are offset from the second plurality of openings.

18. The blank of claim 11, wherein the plurality of panels further comprises a top panel, the top panel comprises at least one handle feature.

19. The blank of claim 11, wherein the at least one attachment panel comprising a container retention portion, an exterior marginal portion foldably connected to the container retention portion, and an interior marginal portion foldably connected to each of the container retention portion and one of the first central panel and the second central panel.

20. The blank of claim 19, wherein the interior marginal portion extends obliquely from the container retention portion to the one of the first central panel and the second central panel.

21. A method of forming a carrier for holding a plurality of containers, the method comprising:

obtaining a blank comprising a plurality of panels comprising at least two central panels and at least one attachment panel, the at least one attachment panel including a pair of retention tabs configured to engage a rim of one or more containers of the plurality of containers, the at least two central panels comprise a first central panel foldably connected to a second central panel, the at least one attachment panel directly connected to one of the first central panel and the second central panel, the first central panel comprises at least one opening; and folding the plurality of panels such that the first central panel and the second central panel are in at least partial face-to-face contact and a portion of the second central panel is exposed through the at least one opening.

22. The method of claim 21, further comprising adhering at least one container of the plurality of containers to the second central panel.

23. The method of claim 22, wherein the adhering comprises applying adhesive to the portion of the second central panel.

24. The method of claim 23, wherein the at least one opening comprises a plurality of openings comprising a first row of openings and a second row of openings spaced apart from the first row of openings.

25. The method of claim 24, wherein the first row of openings is spaced a first distance from a bottom edge of the first central panel, and the second row of openings is spaced a second distance from the bottom edge of the first central panel, the second distance is greater than the first distance.

26. The method of claim 24, wherein the first central panel is a front central panel, the second central panel is a back central panel, the at least one attachment panel is a front attachment panel directly connected to the front central panel, and the plurality of panels further comprises a back attachment panel directly connected to the back central panel, the plurality of openings is a first plurality of openings in the front central panel, and the back central panel comprises a second plurality of openings such that the first plurality of openings are m communication with the back central panel and the second plurality of openings are m communication with the front central panel.

27. The method of claim 26, wherein the first plurality of openings are offset from the second plurality of openings.

28. The method of claim 21, wherein the plurality of panels further comprises a top panel having at least one handle feature, the method comprises overlying the top panel and at least a portion of the at least one attachment panel.

29. A package comprising:

a plurality of containers; and a carrier for holding the plurality of containers, the carrier comprising:

a plurality of panels comprising at least two central panels and at least one attachment panel, the at least one attachment panel including a pair of retention tabs engaging a rim of one or more containers of the plurality of containers, the at least two central panels comprise a first central panel foldably connected to a second central panel, the at least one attachment panel directly connected to one of the first central panel and the second central panel, the first central panel comprises at least one opening, the first central panel and the second central panel are in at least partial face-to-face contact and a portion of the second central panel is exposed through the at least one opening.

30. The package of claim 29, wherein the second central panel is adhered to at least one container of the plurality of containers.

31. The package of claim 30, wherein adhesive is applied to the portion of the second central panel.

32. The package of claim 29, wherein the at least one opening comprises a plurality of openings comprising a first row of openings and a second row of openings spaced apart from the first row of openings.

33. The package of claim 32, wherein the first row of openings is spaced a first distance from a bottom edge of the first central panel, and the second row of openings is spaced a second distance from the bottom edge of the first central panel, the second distance is greater than the first distance.

34. The package of claim 32, wherein the first central panel is a front central panel and the second central panel is a back central panel, the at least one attachment panel is a front attachment panel directly connected to the front central panel, and the plurality of panels further comprises a back attachment panel directly connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

35. The package of claim 34, wherein the first plurality of openings are offset from the second plurality of openings.

36. The package of claim 29, wherein the plurality of panels further comprises a top panel overlying at least a portion of the at least one attachment panel, the top panel comprises at least one handle feature.

37. The package of claim 29, wherein the at least one attachment panel comprising a container retention portion, an exterior marginal portion foldably connected to the container retention portion, and an interior marginal portion directly connected to each of the container retention portion and one of the first central panel and the second central panel.

38. The carrier of claim 37, wherein the interior marginal portion extends obliquely from the container retention portion to the one of the first central panel and the second central panel.

* * * * *